United States Patent [19]

Gebhardt et al.

[11] Patent Number: 4,464,877

[45] Date of Patent: Aug. 14, 1984

[54] METHOD OF ASSEMBLING MULTI-UNIT, PARTY WALL RESIDENTIAL BUILDINGS AND FIRE-RESISTANT PARTY WALL STRUCTURE

[75] Inventors: Ronald E. Gebhardt, Sewickley; Richard C. Haldeman, Bethel Park, both of Pa.; Eric Marten, Dallas, Tex.

[73] Assignee: Ryan Homes, Inc., Pittsburgh, Pa.

[21] Appl. No.: 320,201

[22] Filed: Nov. 12, 1981

[51] Int. Cl.[3] ..... E04B 1/343; E04B 7/16

[52] U.S. Cl. ..... 52/745; 52/79.1; 52/79.7; 52/236.7; 52/580; 52/741

[58] Field of Search ..... 52/79.1, 79.2, 79.9, 52/79.11, 236.1, 236.3, 236.7, 236.9, 580, 741, 745

[56] References Cited

U.S. PATENT DOCUMENTS

| | | | |
|---|---|---|---|
| 3,260,025 | 7/1966 | Van Der Lely | 52/236.7 X |
| 3,331,170 | 7/1967 | Lowe et al. | 52/79.11 |
| 3,638,379 | 2/1972 | Williams | 52/236.3 X |
| 3,800,493 | 4/1974 | Livingston | 52/79.1 X |
| 3,832,812 | 9/1974 | Hiatt | 52/580 X |
| 3,855,743 | 12/1974 | Wokas | 52/79.1 |
| 3,996,709 | 12/1976 | Coxe | 52/169.3 |
| 4,037,379 | 7/1977 | Ozanne | 52/580 |
| 4,090,339 | 5/1978 | Anderson | 52/580 |
| 4,201,020 | 5/1980 | Saunders | 52/79.9 X |
| 4,281,495 | 8/1981 | Lee | 52/580 X |

OTHER PUBLICATIONS

Washington Post, Wed., Apr. 20, 1966, p. A7.

*Primary Examiner*—Alfred C. Perham
*Attorney, Agent, or Firm*—Harry B. Keck

[57] ABSTRACT

A method for assembling multi-unit, party wall residential buildings employs fire-resistant structural panels which are manufactured off-site and installed in the structure as completed party walls. The individual units are assembled side-by-side and thereafter the factory-assembled, fire-resistant party wall panels are introduced into the building covering the contiguous walls of the individual units. Satisfactory fire ratings for the resulting buildings can be achieved. The fire-resistant wall sections are fabricated from a frame which is covered with fire-resistant panels on both surfaces and filled with acoustical insulation.

10 Claims, 20 Drawing Figures

METHOD OF ASSEMBLING MULTI-UNIT, PARTY WALL RESIDENTIAL BUILDINGS AND FIRE-RESISTANT PARTY WALL STRUCTURE

BACKGROUND OF THE INVENTION

1. Field of the Invention

This invention relates to a method of assembling multi-unit, party wall residential buildings and, more particularly, to fire-resistant structural panels which can be employed as the party wall in such buildings when practicing the method.

2. Description of the Prior Art

Multi-unit, party wall residential buildings have been constructed for many years. Such buildings include a number of side-by-side dwelling units. The two end units have an outside end wall and one party wall. All of the intermediate units have two party walls. A requirement of such party walls is that they be fire-resistant. Some building codes require two hours fire resistance for party walls. Other building codes may require only a one-hour fire rating for a party wall. Party walls have been fabricated heretofore from fire-resistant materials such as brick, cinder block, concrete block, gypsum panels, site-applied plaster and the like.

In the usual assembly method for such multi-unit, party wall residential buildings, the units are assembled one by one. For example, a building may commence with a first end unit having an end wall, two side walls and a fire-resistant party wall. Thereafter the contiguous unit can be assembled from its side walls, roof, floors and party wall with the next contiguous unit. Thereafter the third unit can be assembled with its side walls, roof, floors and fire-resistant party wall contiguous with the next unit, and so on, until the second end unit is completed by assembling its side walls, roof, floors and end wall. Alternatively, a central unit may be the first unit to be constructed with its floors, side walls and fire-resistant party walls at each of its ends. The contiguous units on each side can then be assembled with their side walls, roof, floors and fire-resistant party walls or end walls as the case may be. Each of these commonplace construction sequences requires the presence of a variety of different trades throughout the construction process. Floor construction workers, wall construction workers, roof construction workers and party wall assemblers must be present as the building assembly proceeds.

Modern construction techniques for multi-unit, party wall residential buildings have employed factory assembled floor decks, factory assembled side walls, factory assembled end walls, factory assembled or pre-assembled roof units, but have always employed job site assembled fire-resistant party walls. Such factory assembled side walls and end walls are sometimes manufactured as "closed walls" and sometimes as "open walls". An "open wall" is one in which all of the component ingredients are visible for inspection at the job site after the "open wall" unit is secured to the building but before the building is completed. A "closed wall" building unit is one which is covered, partially or totally, on both sides at the factory so that some or all of the components of the "closed wall" unit are not visible for inspection after the unit leaves the factory.

The assembly of the required fire-resistant party walls in multi-unit, party wall residential buildings has been a major cause for delays in the building assembly process.

STATEMENT OF THE INVENTION

According to this invention a building assembly technique is provided for multi-unit, party wall residential buildings whereby each unit is individually assembled to include floor decks, roof units, side walls and, for the end units, end walls secured to a pre-assembled or pre-poured masonry foundation. An appropriate spacing is provided between contiguous units of the building for subsequent introduction of a fire-resistant party wall which is assembled off site and delivered to the job site. The present method permits the rapid assembly of the multi-unit, party wall residential building, initially excluding the party walls, usually in less than one day. Prior to the installation of the party walls between contiguous units, the entire building is uninterrupted from end to end except for certain interior bearing walls and similar interior structures within each unit.

The fire-resistant party walls which are employed in this method are preferably factory assembled to the precise thickness which is maintained between the individual contiguous units so that the factory assembled, fire-resistant party wall structures can be lowered into place between the roofs of contiguous units. Preferably the fire-resistant party wall is manufactured in sections including one section which occupies the first floor level and a different section which occupies the roof level. If the building has two or more stories, then two or more fire-resistant party wall sections are provided, one for each story. Each fire-resistant party wall section is formed about a frame including a top rail, a bottom rail and parallel studs connecting the rails. Fire-resistant panels such as gypsum board are secured to each surface of the frame. Acoustical insulation is applied into the interior of the fire-resistant party wall section between the studs and rails before the second side covering of fire-resistant panels is applied. In a preferred embodiment, the parallel studs, top rail and bottom rail are sheet metal channels and two layers of gypsum board are applied on each side of the frame. The second layer of gypsum board is aligned perpendicular to the first layer. The bottom rail of the first floor fire-retardant party wall section rests on the top of the building foundation party wall which is usually fabricated from masonry such as concrete blocks or cinder blocks. The top rail of the first floor party wall section is profiled, preferably to include at least one shoulder and a channel. The bottom rail of the second floor fire-resistant party wall section has a bottom rail which has a corresponding profile and is adapted to engage into the top rail of the first floor party wall section. The top rail of the second floor party wall section (in a multi-story building) also has a profiled cross-section. The bottom rail of a roofing fire-resistant party wall section has a similar profiled cross-section to engage the top rail of the second floor fire-resistant party wall section in a two-story building. After the fire-retardant party walls are lowered into place, they are connected to the floors and roofs by means of small angles, preferably formed from aluminum or other low temperature melting materials. Preferably a layer of fire-resistant planking such as gypsum board is secured to the edge of each floor deck and roofing section which confronts the fire-resistant party wall. The construction will accommodate building designs having floors of contiguous units at a common level and also building designs having floors of contiguous units at different horizontal levels. The construction also will accommodate building designs having side walls of contiguous units aligned or offset from one another.

DESCRIPTION OF THE PREFERRED EMBODIMENTS

Figure 1:
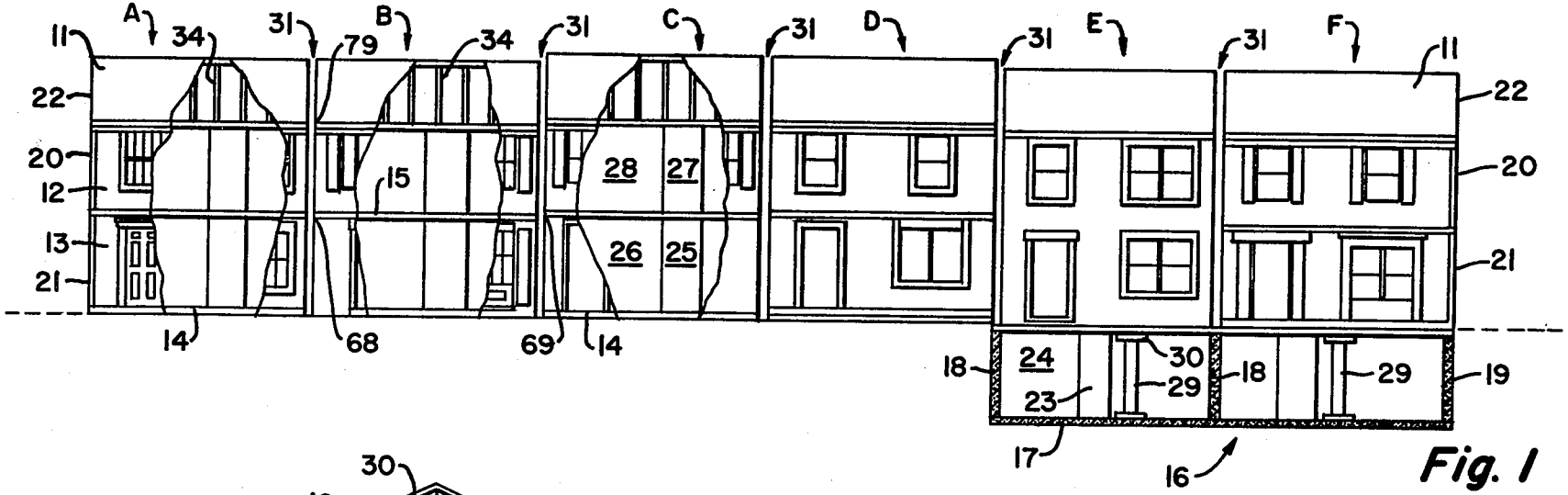
FIG. 1 is a front elevation view, partly broken away, of a typical multi-unit, party wall residential building having six individual units.

A multi-unit, party wall residential building 10 is shown in FIG. 1 including two end units A, F and four interior units B, C, D, E. Each unit has a roof 11, side wall 12 (second floor) and 13 (first floor), first floor deck 14, second floor deck 15, foundation 16 including a foundation floor 17 and masonry party walls 18. The end units have a masonry end wall 19 (only one shown, for unit F). Both end units A, F have end walls 20 (second floor), 21 (first floor) and pitched end walls 22 associated with the roof 11. Within each individual unit there is a plumbing core 23 in the basement 24, a plumbing core 25 in the first story 26, a plumbing core 27 in the second story 28. Within the basement 24, a stanchion column 29 supports transverse beams 30 which in turn support the first floor deck 14. The plumbing elements may be site-installed rather than being supplied as factory-assembled plumbing cores.

Fire-resistant party walls 31 are provided between each pair of contiguous units A-B, B-C, C-D, D-E, E-F.

Figure 2:
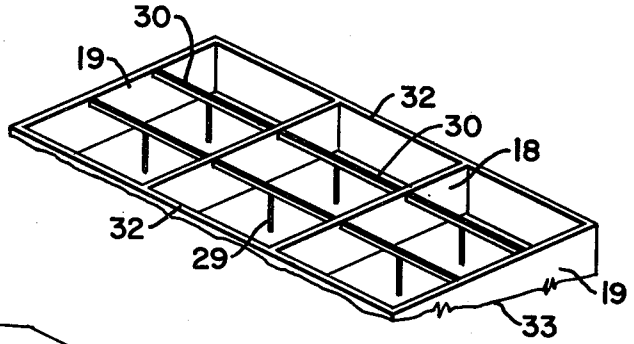
FIG. 2 is a perspective sketch of a building foundation construction for a representative multi-unit, party wall residential building having three units.

A multi-unit, party wall residential building of the type shown in FIG. 1 can be assembled according to the present invention in the sequences illustrated in FIGS. 2 through 9, inclusive. As shown in FIG. 2, the foundation includes masonry party walls 18, masonry end walls 19, masonry side walls 32. The foundation also includes one or more stanchion columns 29 and one or more horizontal beams 30. It will be observed that the top edges of the masonry walls 18, 19, 32 lie in a common horizontal plane in FIG. 2. A representative ground surface grade line 33 is shown in FIG. 2.

Figure 3:
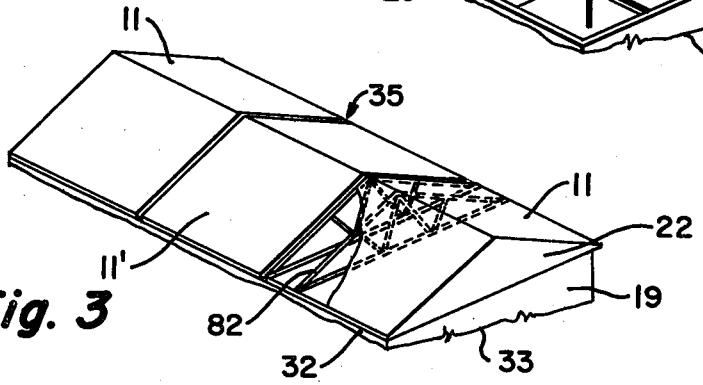
FIG. 3 is a perspective illustration of the building of FIG. 2 with pre-assembled roofs in place over each of the three residential units.

Three individual unit roofs 11 are assembled at the job site from multiple triangular trusses 34 (FIG. 1) and roof coverings such as plywood sheeting. The roofs 11 for the end units include an end wall 22 (one shown in FIG. 3). Interior roofs 11' have no corresponding end wall. The roofs 11, 11' are initially assembled on top of the masonry walls 19, 18, 32. By providing the roofs 11, 11' in this fashion, the building foundation can be protected from precipitation and atmospheric debris. It will be observed that a space 35 is provided between contiguous roofs 11, 11'. During the initial construction stage as shown in FIG. 3, the space 35 can be covered with a ribbon of tar paper, plastic film or other water shedding material.

Figure 4:
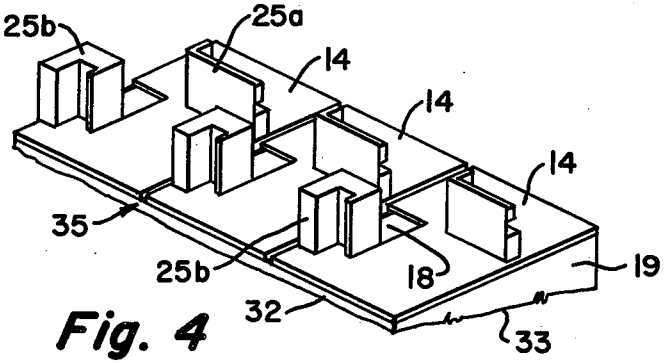
FIG. 4 is an illustration of the building of FIG. 2 after the pre-assembled roof has been removed and includes a first floor deck and building plumbing cores.

When the time comes to assemble the multi-unit, party wall residential building, the roofs 11, 11' are removed by lifting with an appropriate crane. The roofs 11, 11' are carefully placed on the construction site off to the side of the foundation. As shown in FIG. 4, the floor decks 14 are initially positioned on the tops of the masonry foundation walls 19, 18, 32. Each floor deck 14 also receives one or more first floor plumbing cores **25*a*, 25*b*. Typically the plumbing core 25*a* is a kitchen unit including sinks, dishwasher units, ovens, ranges and the like. The core 25*b* typically is a powder room facility including a sink and a toilet. Prior to the application of the first floor decks 14, the basement plumbing core 23 (FIG. 1**) is installed including furnace, air conditioning equipment, laundry tubs, water softeners, et cetera.

Figure 5:
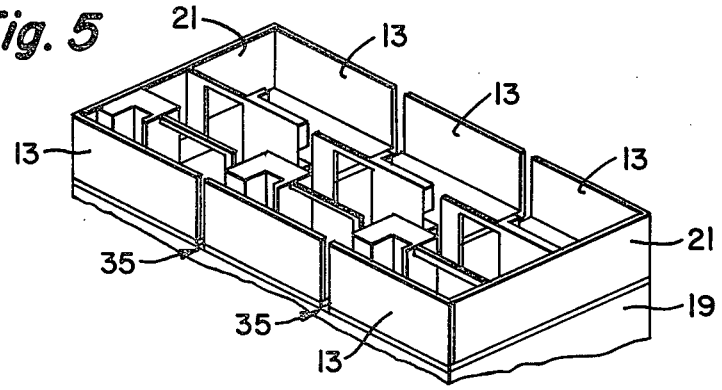
FIG. 5 is a perspective view of the building of FIG. 4 showing the application of first story front walls and end walls.

After all of the elements of FIG. 4 are installed and connected, the first story side walls 13 and end walls 21 are positioned and secured to the building as shown in FIG. 5. It will be observed in FIG. 5 that a space 35 is provided between contiguous side walls 13. It will also be observed from FIG. 4 that a space 35 is provided between floor decks 14 and side walls 13.

Figure 6:
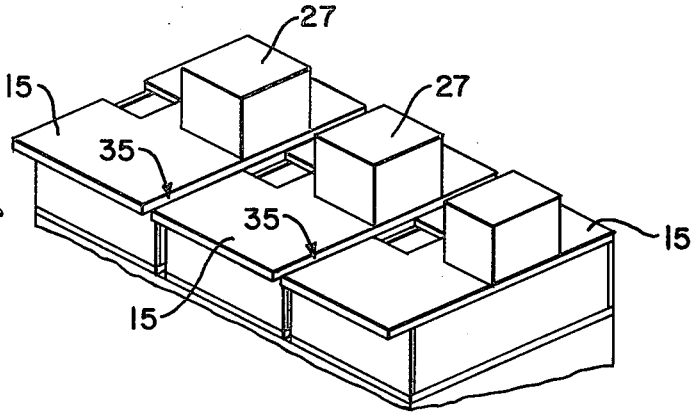
FIG. 6 is a perspective view of the building of FIG. 5 after a second floor deck and plumbing cores have been applied.
Figure 7:
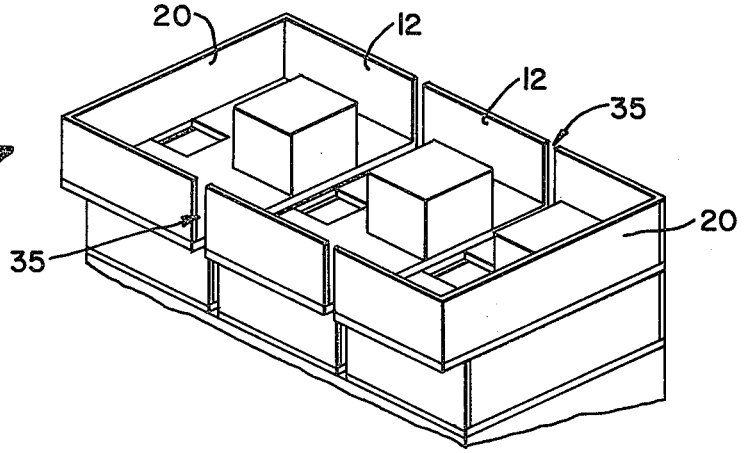
FIG. 7 is a perspective view of the building of FIG. 6 after second story side walls and end walls have been applied.
Figure 8:
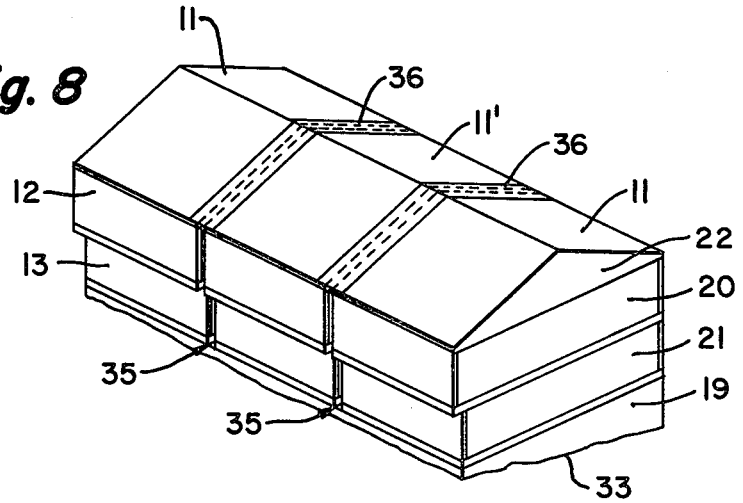
FIG. 8 is a perspective view of the building of FIG. 7 after the roofs have been reapplied.

When the construction of FIG. 5 is completed, second floor decks 15 and second floor plumbing cores 27 are positioned and secured as required as shown in FIG. 6. The second floor plumbing cores 27 customarily include a combination bathtub/shower stall, a sink, toilet and accessories. The second floor plumbing core 27 may also include a ceramic tile or plastic floor. It will be observed that a space 35 is provided between the second story floor decks 15 of contiguous units. The second story side walls 12 and end walls 20 are secured to the units as shown in FIG. 7. A space 35 is maintained between the side walls 12 of contiguous units. Finally, the roofs 11, 11' are lifted and returned to the building on top of the assembled second story as shown in FIG. 8. It will also be observed that a space 35 is maintained between the roofs 11, 11' of contiguous units.

Figure 9:
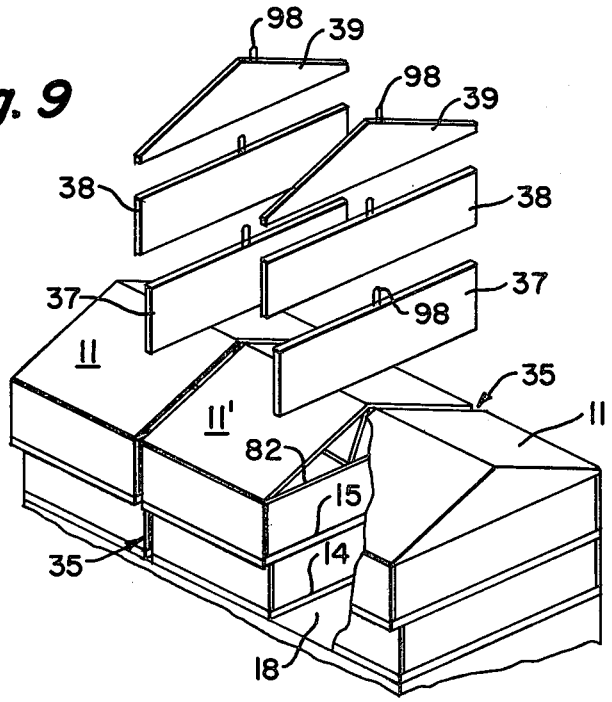
FIG. 9 is a perspective view, partly schematic, showing the manner in which a fire-resistant party wall structure is introduced into the building of FIG. 8.

All of the operations shown in FIGS. 3 through 8, inclusive, can be completed in a brief period of time, usually less than one day for a complete building containing multiple units. It will be observed that the structure, as shown in FIG. 8, contains no fire-retardant party walls between contiguous units. A protective ribbon 36 of roofing paper or water shedding film is applied over the space 35 to prevent entry of atmospheric water or debris into the interior of the building. It will be noted that the entire building as shown in FIG. 8 is unobstructed between the end walls 20, 21 at one end and the other end walls (not seen in FIG. 8). When all of the desired interior work is completed within the building of FIG. 8, the fire-resistant party walls may be installed as shown in FIG. 9. A crane (not shown) lifts party wall sections 37, 38, 39 in sequence after the protective ribbon 36 is removed from the space 35. The first story fire-resistant party wall section 37 is lowered between the roofs 11, 11' into the space 35 and is allowed to settle to rest upon the top surface of the masonry party wall 18. It will be observed that the first story fire-retardant party wall section 37 extends below the floor surface level of the first floor deck 14. A second story fire-retardant party wall section 38 is thereafter lowered between the contiguous roofs 11, 11' into the space 35 to rest upon the first story fire-retardant party wall section 37. Finally, a triangular shaped fire-retardant party wall section 39 is lowered between the contiguous roofs 11, 11' to rest upon the second story fire-retardant party wall section 38.

Thereafter the weather-resistant roofing is applied to the roofs 11, 11'. Appropriate weather-resistant covering is applied to the side walls 12, 13 covering the space 35 to complete the weather-resistant envelope for the building.

Figure 10:
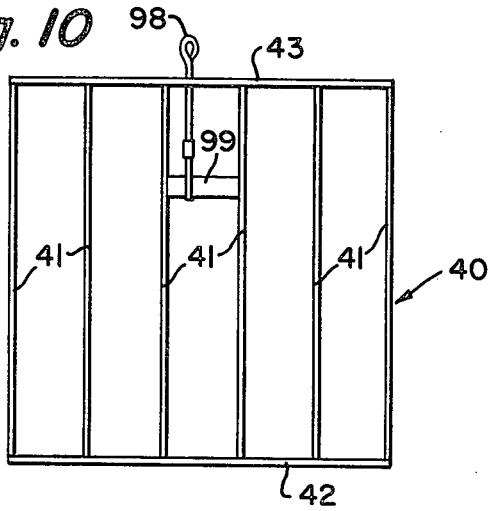
FIG. 10 is an elevation view of a frame assembled for producing a fire-resistant party wall section according to this invention.
Figure 11:
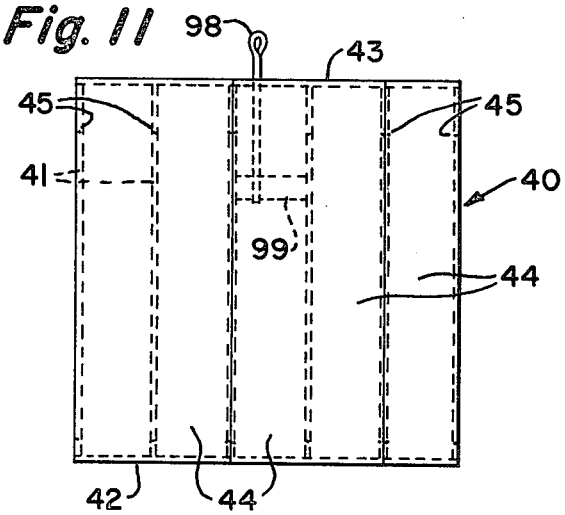
FIG. 11 is an elevation view of the fire-resistant party wall of FIG. 10 after a first layer of fire-resistant gypsum board has been applied.
Figure 12:
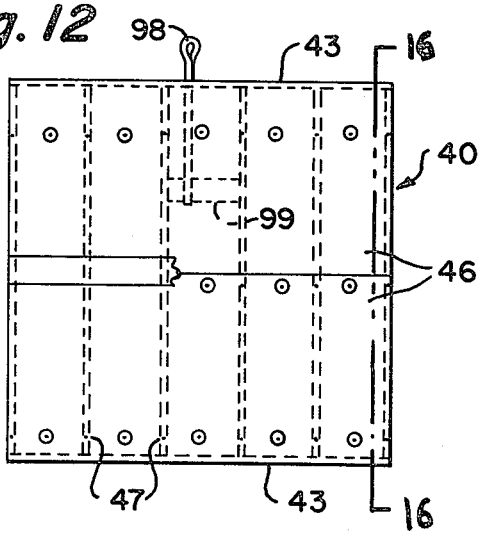
FIG. 12 is an elevation view of the fire-retardant party wall of FIG. 11 after a second layer of fire-resistant gypsum board has been applied.

Each individual fire-retardant party wall section is fabricated from a frame and one or more layers of fire-retardant panels on each side of the frame. The interior of the frame is filled with acoustic insulation material. A preferred fire-resistant party wall section is assembled as shown in FIGS. 10, 11, 12 by forming a frame 40 of plural parallel studs 41, a bottom rail 42 and a top rail 43. The studs 41 and rails 42, 43 are secured by fasteners, e.g., pop rivets or screws. Preferably the studs 40 are sheet metal channels formed from light-gauge galvanized steel and the rails 42, 43 are also fabricated from light-gauge galvanized steel in a channel profile or in a selected profile as hereinafter described. After the frame 40 is assembled, a first layer of gypsum panels 44 is secured preferably parallel to the studs 41 by means of dry wall fasteners 45 which extend through the fire-retardant panels 44 into the studs 41 and rails 42, 43. Thereafter a second layer of fire-retardant panels 46 is applied on top of the first layer of panels 44 and aligned at right angles thereto and secured by means of dry wall fasteners 47 to the subjacent studs 41 and rails 42, 43. After the fire-resistant panels 44, 46 are secured to one side of the frame 40, appropriate acoustic insulation material is introduced into the space defined by the studs 41 and rails 42, 43. Typically, fiberglass insulation batts are employed for this purpose. Batts of glass fibers having a density of about 0.6 pounds per cubic foot have excellent acoustical absorption characteristics.

Thereafter a corresponding set of fire-resistant panels 44 and 46 is applied to the other side of the frame 40 to complete the factory assembly of the fire-resistant party wall section.

Figure 13:
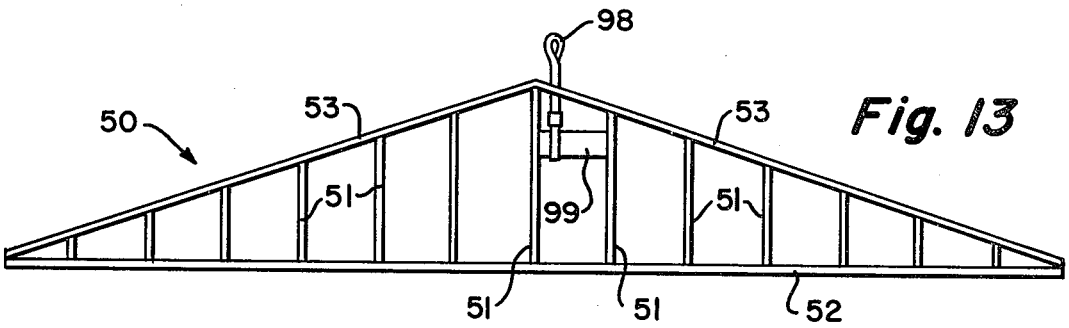
FIG. 13 is an elevation view of a frame for assembling a roof section of a fire-retardant party wall.
Figure 14:
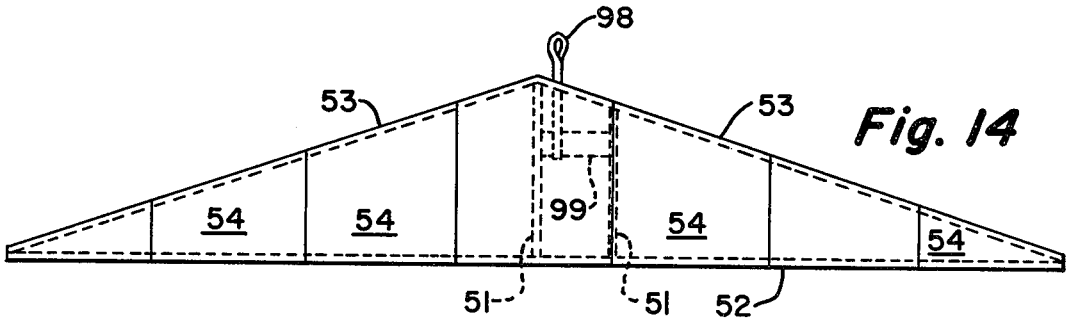
FIG. 14 is an elevation view of the fire-retardant party wall of FIG. 13 after a first layer of fire-retardant gypsum board has been applied.
Figure 15:
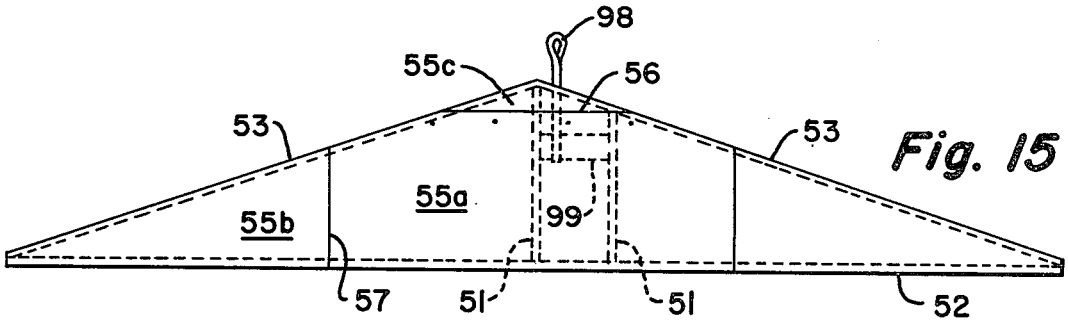
FIG. 15 is an elevation view of the roof section of the fire-retardant party wall of FIG. 14 after a second layer of fire-retardant gypsum board has been applied.

A gable section of the fire-resistant party wall panel is fabricated as shown in FIGS. 13, 14, 15 wherein a frame 50 is fabricated from parallel studs 51, a bottom rail 52 and two top rails 53. It will be apparent that the section shown in FIG. 13 is intended for a central pitched roof of the type which is illustrated in FIGS. 2 through 9, inclusive. Other sloping roof profiles can be adopted to take advantage of the present invention.

A first layer of fire-retardant panels 54 is applied to the frame 50 generally parallel to the studs 51 as shown in FIG. 14. Thereafter fire-retardant panels 55 of different shapes are secured to the first layer of fire-resistant panels 54 as shown by the side connection seam 56 between the panels **55*a*, 55*c*. The seam 57 between panels 55*a*, 55*b* is positioned to be offset from the side-by-side seams 56 of the panels 54 of FIG. 14 to avoid overlying vertical seams. After one side of the frame 50 has been covered with the fire-retardant panels 54, 55, appropriate acoustic insulation material is placed in the spaces defined by the studs 51 and the rails 52, 53. Thereafter the other side of the frame 50 is covered with vertically aligned fire-retardant panels 54 and horizontally aligned fire-retardant panels 55** to complete the gable fire-retardant party wall section.

Preferably the rails 52 (FIG. 13) and 43 (FIG. 10) have a selected profile to permit interengagement to facilitate support for the superjacent sections and to improve the fire-retardant properties of the resulting fire-retardant party wall.

Figure 16:
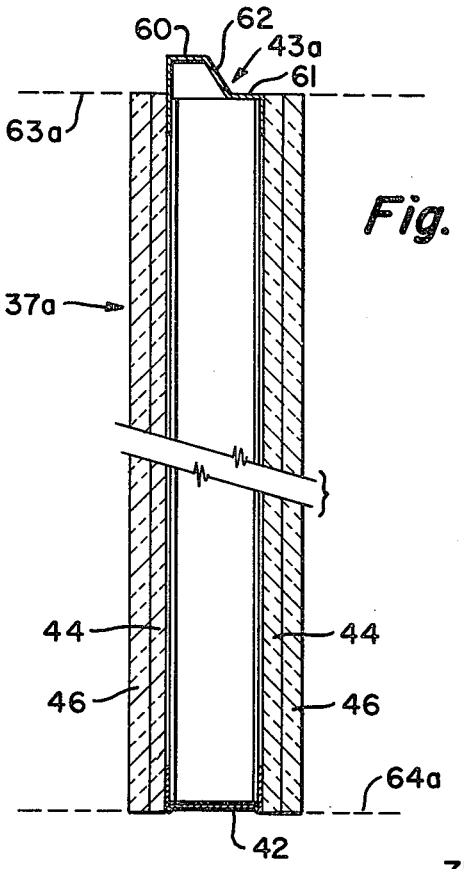
FIG. 16 is a fragmentary cross-section view taken along the line 16—16 of FIG. 12.

Referring to FIG. 16, there is illustrated in broken cross-section a fire-resistant party wall section of the type employed at the first story level of a multi-story building or as the first story section of a one-story building. It will be observed that the section **37*a* has a bottom rail 42*a* which is U-shaped and is a conventional metal wall rail. The top rail 43*a* is profiled to include two distinct shoulders 60, 61. An intermediate sloping surface 62 provides for a smooth connection during assembly of the section 37*a* with a superposed section, hereinafter described. It will be observed that the fire-resistant panels 44, 46 terminate in a common plane identified by the numeral 63*a* at the top and the numeral 64*a* at the bottom. The plane 64*a* coincides with the top level of the masonry party wall 18 of FIGS. 1, 2**.

Figure 17:
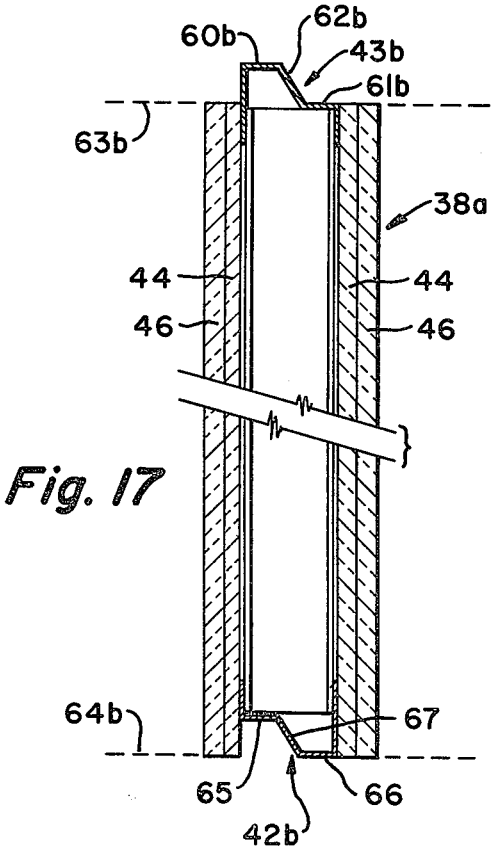
FIG. 17 is a view similar to FIG. 16 showing a fragmentary cross-section of a second story fire-resistant party wall section.

An intermediate fire-retardant party wall section **38*a* is illustrated in FIG. 17 including a bottom rail 42*b* and a top rail 43*b* which are correspondingly profiled. The top rail 43*b* includes an upper shoulder 60*b* and a lower shoulder 61*b* with an intermediate sloping surface 62*b*. The fire-resistant panels 44, 46 terminate in a common plane 63*b* at the top and in a common plane 64*b* at the bottom. The bottom rail 42***b* has two shoulders 65, 66 which are vertically spaced apart joined by a connecting sloping surface 67. When the intermediate fire-retardant party wall section 38*a* is superposed on the fire-retardant party wall section 37*a*, the two rails 42*b* (FIG. 17) and 43*a* (FIG. 16) interconnect as the section 38*a* slides downwardly to engage the section 37*a*. A completed connection appears in FIG. 20.

The gable fire-retardant party wall section of FIGS. 13, 14, 15 includes a profiled bottom rail 52 corresponding to the top rail 43*a* (FIG. 16) or 43*b* (FIG. 17) and also includes a channel-shaped top rail 53.

Figure 18:
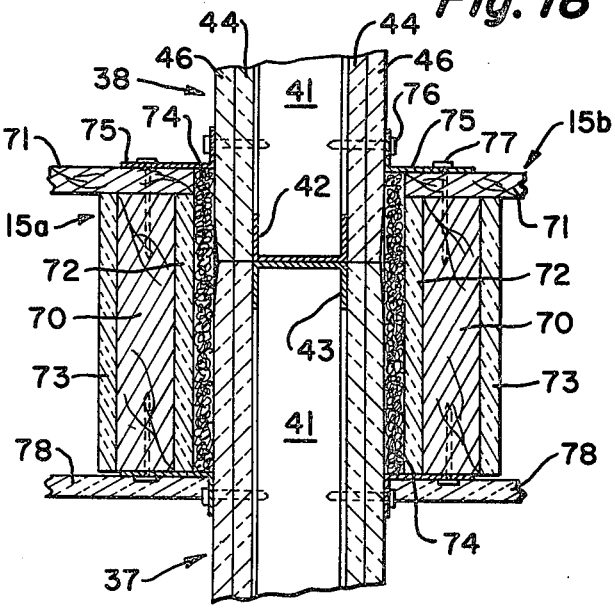
FIG. 18 is a cross-section view of the juncture of floor decks of two contiguous units of a multi-unit, party wall residential building showing the connection of two fire-resistant party wall sections.

Referring to FIG. 1, there is illustrated at 68 a connection wherein the floor decks 15 of units A, B lie in a common plane. A different condition exists at 69 between units B, C where the floor decks 15 do not lie in a common plane but are vertically spaced apart. The manner of making the connection at 68 is illustrated in FIG. 18. The manner of making the connection at 69 is illustrated in FIG. 20.

Referring to FIG. 18, two floor decks 15*a*, 15*b* are normally formed from joists 70 and a covering plywood layer 71. The bottom fire-resistant party wall section 37 is shown with a U-shaped upper rail 43. The bottom rail of the upper fire-resistant party wall section 38 is shown as having a U-shaped bottom rail 42. It should be noted that the junction between the upper section 38 and the lower section 37 occurs at the level of the floor decks 15*a*, 15*b*. In a preferred embodiment, a strip 72 of fire-retardant material such as one-half inch thick gypsum board is applied to the confronting edge of the floor decks 15*a*, 15*b*. If desired, a further strip of fire-resistant material 73 can be applied to the remote surfaces of the confronting joists 70. The space between the strips 72 and the fire-resistant party wall sections 37, 38 is filled with incombustible packing such as mineral wool 74. It is not necessary to provide any additional connections in order to render the resulting building structurally sound. Each of the individual building units A, B, et cetera, is independently structurally sound. However, it is preferable to apply small light-gauge angle clips 75 by means of fasteners 76, 77 at the top and bottom of each floor deck 15*a*, 15*b*. The fasteners 76 normally are screw fasteners which penetrate the fire-retardant panels 44, 46 and are secured in an underlying stud 41. The angles 75 preferably are of low melting temperature material such as aluminum for reasons which will be discussed hereafter. After the construction is completed, a fire-retardant ceiling 78 is applied to the undersurface of the floor deck 15*a*, 15*b*, normally gypsum ceiling panels.

Figure 19:
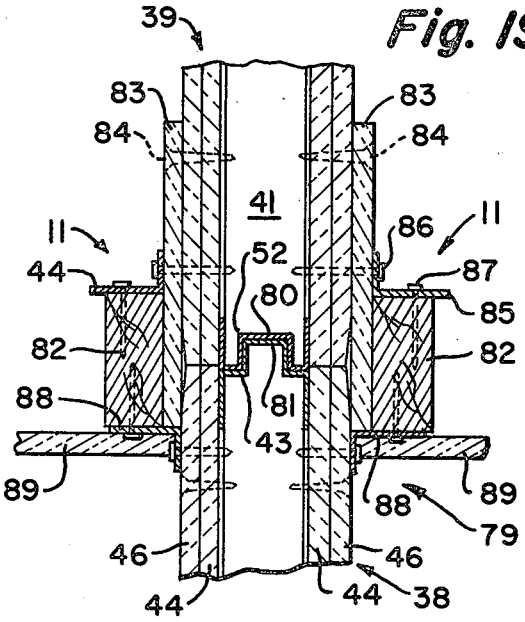
FIG. 19 is a cross-section view of the juncture of roof sections of two contiguous units of a multi-unit, party wall residential building.
Figure 20:
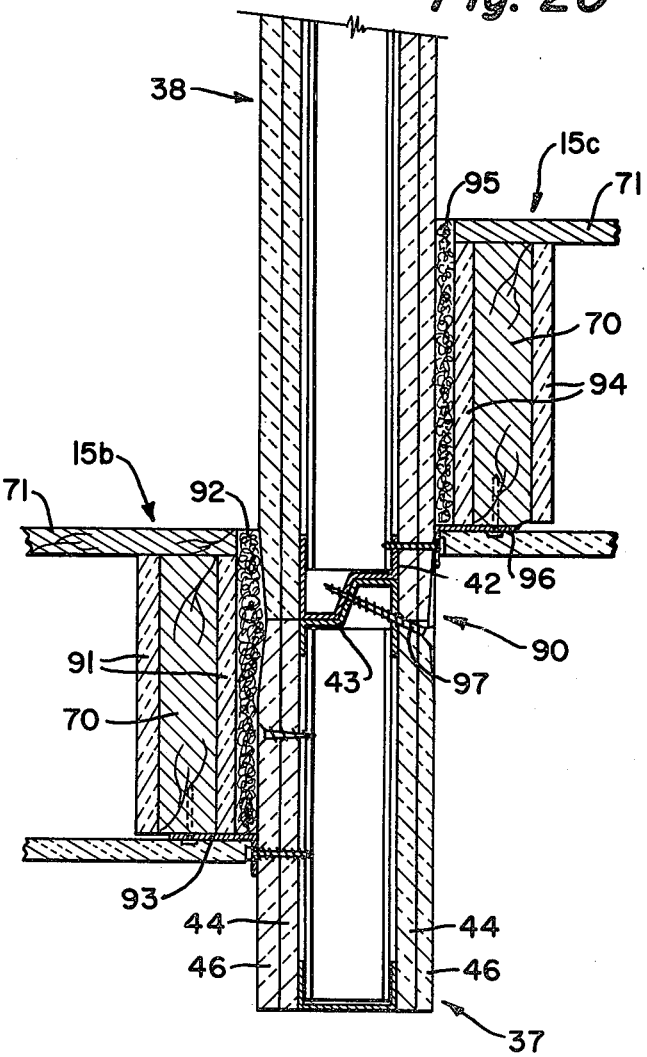
FIG. 20 is a cross-section view, similar to FIG. 18, showing a juncture of two contiguous units of a multi-unit, party wall residential building having the floor decks of one unit at a level different from that of the floor decks of the contiguous unit.

The roof connection 79 in FIG. 1 has the roof frames at a common level. The connection 79 is illustrated more clearly in FIG. 19 wherein the upper fire-retardant party wall section 39 has a bottom rail 52 is profiled with a groove 80. The corresponding upper rail 43 of the intermediate fire-resistant party wall section 37 has a corresponding profile including a bead 81. The roofing elements 11 include a horizontal bottom chord 82 of a roof truss which spans the distance between the side walls of the building as seen in FIG. 9. The triangular upper fire-resistant party wall section 39 forms a joint with the supporting section 38 between the chords 82. A strip 83 of fire-retardant material such as one-half inch thick gypsum board is applied between the chords 82 and the outer surfaces of the fire-resistant layers 46 of the two fire-resistant party wall sections 38, 39. The strips 83 are secured by means of fasteners 84 through the layers 46, 44 into the studs 41. Additional angle clips 85 are secured by threaded fasteners 86 and nails 87 to the chords 82 and through the strip 83 layers 46, 44 into the stud 41. A bottom angle clip 88 also is secured to the chord 82 and to the fire-retardant party wall section 37. A fire-retardant ceiling 89 is secured to the undersurface of the roof by connection to the undersurface of the chords 82.

Where the floor decks of contiguous units are not in a common plane, for example at 69 in FIG. 1 between units B and C, an alternative connection is provided as shown in FIG. 20. The joint 90 cannot be located between both of the floor decks and accordingly the joint 90 of FIG. 20 is proposed. Herein, the bottom section 37 has a top rail 43 of the type shown in FIG. 16. The top section 38 has a bottom rail 42 of the type shown in FIG. 17. The left-hand deck 15*b* is shown in FIG. 20 at a lower level than the right-hand floor deck 15*c*. Both decks are otherwise similar and are formed from joists 70 and plywood layers 71. It will be recalled that the floor deck 15*b* is an integral component of the unit B prior to the installation of the fire-resistant party wall. Similarly, the floor deck 15*c* is an integral ingredient of the unit C prior to the installation of the fire-retardant party wall. That is, the floor decks 15*b*, 15*c* do not require any structural support from one another. The bottom fire-resistant party wall panel 37 initially is lowered into position as shown in FIG. 9 with its upper rail 43 lying at the level of the lower floor deck 15*b*. Layers of fire-retardant material such as strips of gypsum board 91 are applied to the confronting surface of the joist 70 and, if desired, to the remote surface of the joist 70. The space between the fire-retardant sections 37, 38 and the strip 91 is stuffed with fire-resistant filler such as mineral wool 92. An angle clip 93 connects the undersurface of the joist 70 to the lower fire-resistant party wall section 37.

The other floor joist 15*c* similarly is equipped with fire-resistant strips 94 on the confronting surface of the joist 70 and, if desired, on the remote surface of the joist 70. The space between the fire-resistant strip 91 and the upper fire-resistant party wall section 37 is filled with compressible filler 95. An angle clip 96 connects the undersurface of the joist 70 to the upper fire-resistant party wall section 38.

It will be observed that the joint 90 does not provide a straight-through passageway for wicking transfer of heat through the party wall in either direction.

An angled screw fastener 97 is applied through the fire-resistant panels 44, 46 surface of the fire-resistant panels 44, 46 into the engaged rails 42, 43.

The reason for having the angle clips 93, 96 (FIG. 20), 85 (FIG. 19), 75 (FIG. 18) fabricated from low temperature melting metal such as aluminum is to permit the floor decks or roof sections to separate from the party wall in any unit where a fire might occur rather than have such floor decks or roof sections pull down the fire-resistant party wall.

When the fire-resistant party wall sections are fabricated from 25-gauge galvanized steel channels and two layers of one-half inch thick gypsum board are applied as the fire-resistant coatings, the present panels have established under test a two-hour fire rating. While there are many instances where two-hour fire ratings are required or desirable, there are other instances where a one-hour fire rating is acceptable and feasible. One-hour fire ratings for fire-resistant party walls can be achieved by employing wooden studs and rails or plates (for example, 2×4 studs and rails) along with a single covering of fire-resistant material, for example, $\frac{5}{8}$ inch thick gypsum board. Such panels are assembled and connected in the same manner as described herein where the lower fire rating is acceptable.

By employing the present assembly procedure and the present fire-retardant party wall structures, significant economies are achieved in the assembly of multi-unit, party wall residential buildings. One advantage is that the entire building—except for the fire-retardant party walls—may be assembled in a brief period of time, covered with a roof and rendered weathertight. A variety of interior finishing operations can be carried out in the building after it has been covered and before the fire-retardant party walls are installed. All of the fire-retardant party walls may be installed in a brief period of time with a small staff of job site labor. The fire-retardant party wall as described has successfully passed fire tests.

In many multi-unit, party wall residential buildings, the contiguous units may be offset vertically as illustrated at 69 in FIG. 1 wherein the floor decks lie in different horizontal planes. The units also may be offset from front to back whereby the outer walls do not lie in a common plane. Where this condition exists, there nevertheless is a significant area where the two contiguous units do have a common party wall area. It is this common party wall area which is maintained spaced-apart to receive the fire-resistant party wall sections of this invention.

Referring to FIGS. 9, 10, 11, 12, 13, 14, 15, there is illustrated a unique carrying strap for the present fire-resistant party wall sections. Referring to FIG. 9, a loop 98 of steel strapping extends above the top center region of each of the fire-resistant party wall sections 37, 38, 39. The loop 98 is employed to lift the sections and to lower them into position in the space 35. Typically, two or more loops 98 will be provided for the party wall sections 37, 38 to distribute the weight of those sections and to facilitate handling. One loop 98 usually is sufficient for the roof party wall sections 39 although more than one loop 98 may be supplied.

The loop 98 of steel strapping, as shown in FIGS. 10 and 13, extends through a slot (not shown) in the upper rail 43 (FIG. 10), 53 (FIG. 13) and into the space between parallel studs 41 (FIG. 10), 51 (FIG. 13) to a block 99 which is secured between the vertical studs. The block 99 may be a length of 2×8 or 2×6 wood cut to fit precisely between adjacent studs. The metal strapping of the loop 98 is looped around the block 99 and the ends of the strapping are spliced. More than one loop 98 may be provided in different spaces between studs to distribute the load of the fire-resistant party wall section.

After the fire-resistant party wall sections are positioned within the building, the loop 98 is cut at the top rail 43 (FIG. 10), 53 (FIG. 13) and is allowed to remain within the party wall section.

We claim:

1. A method of assembling a multi-unit, party wall building on a foundation comprising the steps of connecting at least one floor deck, vertical side walls and a roof for each said unit and connecting a vertical end wall to the end units of each building, maintaining an opening between the contiguous units above the said foundation, and thereafter installing a fire-resistant party wall between contiguous units by sliding party wall sections downwardly between the roofs of the contiguous units.

2. The method of claim 1 wherein each unit has two floor decks.

3. The method of claim 1 wherein each said fire-resistant party wall comprises a section corresponding to the contiguous area between contiguous units for each floor deck and a top section corresponding to the contiguous area between contiguous roofs.

4. The method of claim 1 wherein each said fire-resistant party wall comprises at least two sections which are abutted along a horizontal seam which is at a level coinciding with at least one said floor deck.

5. The method of claim 4 wherein said fire-resistant filler is provided in the space between the said horizontal seam and the said floor deck.

6. The method of claim 4 wherein a layer of fire-resistant sheeting is applied to the underside of a said floor deck after the said fire-resistant party wall is installed, said fire-resistant sheeting comprising a ceiling surface for a said unit.

7. The method of claim 1 wherein each of the said party wall sections comprises an incombustible frame having two layers of fire-resistant sheeting on each surface thereof.

8. The method of claim 7 wherein each of the said party wall sections has acoustical insulation between the inner layers of said fire-resistant sheeting.

9. The method of claim 1 wherein a said floor deck is secured to a said fire-resistant party wall section by means of a light gauge sheet metal clip.

10. The method of claim 1 wherein the said light gauge sheet metal clip is aluminum.

* * * * *